US006006453A

United States Patent [19]

Klebahn et al.

[11] Patent Number: 6,006,453

[45] Date of Patent: Dec. 28, 1999

[54] SNOWSHOE CONSTRUCTION

[75] Inventors: Perry A. Klebahn, San Francisco; Daniel T. Emerson, Palo Alto, both of Calif.

[73] Assignee: Tubbs Snowshoe Company LLC, Stowe, Vt.

[21] Appl. No.: 09/285,504

[22] Filed: Apr. 2, 1999

Related U.S. Application Data

[63] Continuation of application No. 08/787,636, Jan. 23, 1997, abandoned.

[51] Int. Cl.[6] ..... A43B 5/00

[52] U.S. Cl. ..... 36/123; 36/124

[58] Field of Search ..... 36/122, 123, 125, 36/124

[56] References Cited

U.S. PATENT DOCUMENTS

| | | | |
|---|---|---|---|
| 3,636,643 | 1/1972 | Lundquist | 36/123 |
| 3,638,333 | 2/1972 | Sprandel | 36/122 |
| 3,760,513 | 9/1973 | Corneliusen . | |
| 4,045,889 | 9/1977 | Woolworth | 36/122 |
| 4,348,823 | 9/1982 | Knapp et al. | 36/123 |
| 4,720,928 | 1/1988 | Faber et al. . | |
| 5,253,437 | 10/1993 | Klebahn et al. . | |
| 5,259,128 | 11/1993 | Howell | 36/122 |
| 5,309,652 | 5/1994 | Campbell | 36/124 |
| 5,440,827 | 8/1995 | Klebahn et al. . | |
| 5,459,950 | 10/1995 | Damm et al. | 36/122 |
| 5,469,643 | 11/1995 | Forrest . | |
| 5,517,772 | 5/1996 | Anderson | 36/122 |

*Primary Examiner*—Ted Kavanaugh
*Attorney, Agent, or Firm*—Thomas M. Freiburger

[57] ABSTRACT

A snowshoe is constructed of molded plastic nose and tail pieces, both connected to a pair of rigid rails to complete the snowshoe frame. A stretched deck membrane, in an area over the heel of a user's shoe or boot, has left and right sides secured to the rails, and preferably is also supported on the tail piece and on aft portions of the nose piece. In one embodiment the rails are of tubular metal, secured to aft portions of the nose piece and forward portions of the tail piece via reinforced, shaped cavities in the molded plastic, contoured to receive the rails. The snowshoe construction is efficient in assembly and cost because there is no need for bends in the rails, the molded plastic components are relatively inexpensive, and snowshoes of different lengths may be produced simply by changing the lengths of the rails and of the deck membrane. In one specific embodiment the rails are extendable, as with telescopically fitted tubing sections, so that the length of a snowshoe may be adjusted for different snow conditions.

4 Claims, 6 Drawing Sheets

SNOWSHOE CONSTRUCTION

This is a continuation of application Ser. No. 787,636, filed Jan. 23, 1997, now abandoned.

BACKGROUND OF THE INVENTION

This invention concerns snowshoes, and more specifically the invention is directed to a snowshoe of hybrid construction, in which a pair of spaced rails form a central part of the frame, and molded plastic pieces form the nose and tail of the snowshoe.

Conventional snowshoes have been constructed in several different ways. One construction currently used is a bent frame construction, shown, for example, in U.S. Pat. No. 5,440,827, in which a metal frame (typically aluminum tubing) is formed with a number of bends, welded together at the tail end, to form the periphery of the snowshoe to which decking is attached. Another snowshoe construction essentially entirely of molded plastic, but with longitudinal reinforcing metal rails, is shown in U.S. Pat. No. 5,469,643.

Snowshoe frame s constructed of formed and welded tubing are sturdy and reliable, but relatively expensive to produce. The all-molded plastic snowshoe of the latter patent referenced above, although a departure from most conventional snowshoe construction, does not represent a significant savings in construction costs, in part because of the need to assemble metal rails onto the bottom of the molded snowshoe deck, to provide sufficient rigidity; the all-molded snowshoe also lacks flexibility under the user's heel.

It is among the objects of this invention to form a snowshoe by hybrid construction, wherein a pair of spaced rails form the center of the snowshoe frame, with front and rear ends formed by relatively rigid molded plastic components secured to the rails, avoiding the need for an expensive metal frame and providing for versatility in producing snowshoes of different lengths.

SUMMARY OF THE INVENTION

A snowshoe constructed according to the invention has a nose of molded plastic material, which may be injection molded plastic, including a pair of rail-receiving aft portions positioned at outboard sides of the nose. A tail of similar molded plastic material has a pair of rail-receiving forward portions. Extending generally longitudinally between the nose and tail pieces are a pair of spaced apart rails which are secured to the nose and tail to give the snowshoe structural rigidity and to complete the snowshoe frame. The frame can be considered as formed by the rails and the periphery of the nose and tail pieces.

Located generally under the heel of the user is a flexible deck membrane extending between and secured to the two rails at left and right and preferably also secured to the front end of the tail piece and also to aft portions of the nose piece, or to the rails near the aft end of the nose piece. Near the forward end of the snowshoe is a boot harness, secured to a front claw assembly as in the above-referenced U.S. Pat. No. 5,440,827. Also as in that patent, the front claw/harness assembly is pivotable relative to the snowshoe frame, so that the tail can tip downwardly as the user takes a step forward. In the present invention the pivot connection may be made by means of pins securing the front claw structure to the aft portions of the nose piece, or to the rails, or both. In a preferred construction, a pin at each side secures the claw pivotally to the nose portions and to the metal rail, with the pin passing through the rail, thus also helping to secure the rails to the nose piece.

It is advantageous for the two rails to be straight, avoiding the need for bends as in prior construction, so that all bends are located in the molded plastic components. The rails may be formed of metal tubing, but many other cross sections are possible, such as square tubing, L-shaped structural members, etc. Also, the rails may be formed of material other than metal, such as injection molded plastic or composite materials, some of these materials being advantageous in that they can be directly bonded to the nose and tail pieces by heat bonding.

In a preferred embodiment the flexible membrane is stretched relatively tightly between the rails, wrapped around the rails at left and right, and riveted or heat sealed back to itself to complete the connection. Preferably a reinforcing layer is included, at the bottom of at least a portion of the stretched membrane, and a heel cleat with downwardly extending legs may be assembled so as to protrude through slits in the lower reinforcing layer. The reinforcing layer may advantageously be heat bonded to the main, upper layer, as by RF bonding or ultrasonic bonding. Such a flexible member for contact of the user's heel is an important feature to prevent discomfort, pain or injury to the user. Rigid material can be behind the heel, but a surface which gives is important under the heel.

The nose and tail pieces of the hybrid snowshoe, in one preferred embodiment, have downwardly protruding skegs, preferably at outboard locations, for engaging the terrain and preventing lateral slippage. These skegs, if included, are integral with the aft portions of the nose piece and the forward portions of the tail piece.

As is apparent from the construction described above, various different lengths of snowshoes can be produced simply by changing the length of rails included in the snowshoe frame. For different snowshoe lengths, the length of the stretched deck membrane is also modified, but if desired, a single deck component can be used for a number of different snowshoe lengths, by securing the rear end of the flexible deck through a slot in the tail piece and back against itself with different degrees of overlap. Thus, the invention encompasses not only the snowshoe itself, but also a method of constructing snowshoes of various lengths using the same components but with different rail lengths.

In one form of a snowshoe construction under the invention, a snowshoe is length-adjustable, through adjustment of the lengths of the rails. The rails, which can each comprise two-piece telescoped components, can be adjusted in length by depressing spring-biased lock buttons on the rails, enabling extension or retraction of the rails to different length positions in which the lock buttons will engage. Such length adjustment gives the snowshoes versatility for different conditions of snow density, different weights of users, or both; it also allows the snowshoe to be collapsed to a shorter length for storage and transport. The stretched flexible deck membrane can have a tail portion, secured through the slot in the tail piece, which has a large overlap that snaps against the bottom surface of the membrane at several different locations, accommodating the different snowshoe lengths. Two, three, four or more positions can be defined, thus providing for a similar number of snowshoe lengths.

In a variation of the snowshoe construction described above, the snowshoe can be formed with a molded plastic nose piece, but otherwise by a contoured frame which may be similar in most respects to that of U.S. Pat. No. 5,440,827 behind the harness assembly. This still obtains the benefit of fewer bends, in the case of a tubular metal frame, particularly at the forward end of a snowshoe where this part of the frame formation is most costly. In this regard, the disclosure of U.S. Pat. No. 5,440,827 is incorporated herein by reference relative to the frame, decking and heel cleat construction behind the harness assembly.

Although the rails, i.e., the intermediate frame members, are often described herein as of metal, or tubular metal in particular, they can, as noted above, be formed of molded plastic or composite materials, and this includes the construction just described wherein a frame including the central and tail portions is secured to a front nose piece of molded plastic material.

It is therefore a primary object of the invention to improve in the economy of production of a sturdy and rugged snowshoe, while also providing for versatility in production of similar snowshoes of different lengths, and in providing a single snowshoe which is easily adjustable in length. These and other objects, advantages and features will be apparent from the following description of preferred embodiments, considered along with the accompanying drawings.

DESCRIPTION OF PREFERRED EMBODIMENTS

Figure 1:
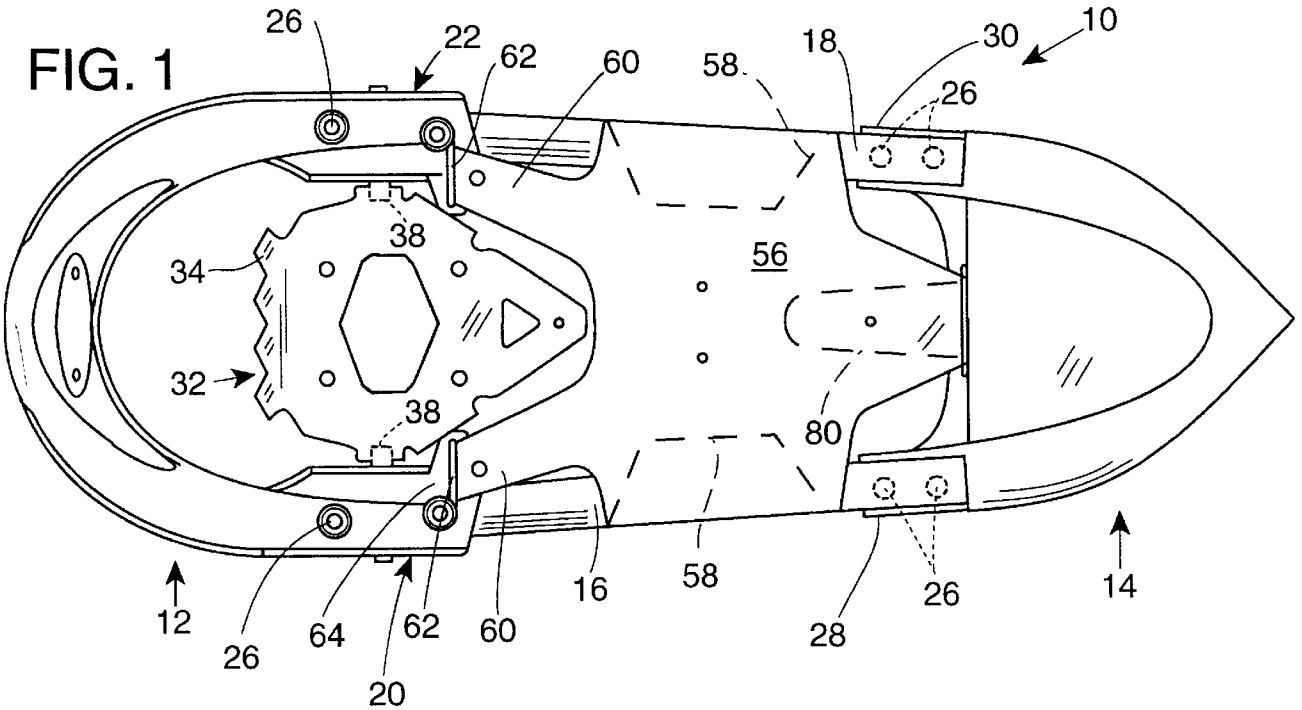
FIG. 1 is a plan view showing a snowshoe construction according to the invention but without the boot harness.

In FIGS. 1–5 of the drawings is shown a snowshoe 10 of hybrid construction, in which a nose 12 and a tail 14 are formed of molded plastic, preferably injection molded plastic, and the remainder of the frame is formed by left and right rails 16 and 18, each being secured to each of the nose and tail pieces 12 and 14. As indicated above, the rails 16 and 18 can comprise any suitable structural members, but in one preferred embodiment are tubular metal rails, such as of aluminum. The nose molding 12 has a pair of rail-receiving aft portions 20 and 22 as shown, each of the rail receiving aft portions 20 and 22 has a contoured cavity 24 as shown in FIG. 6, configured to closely receive the end of the rail, these aft portions 20 and 22 having integrally molded reinforcing structure to strengthen the connections between the rails and the nose piece 12.

Figure 7:
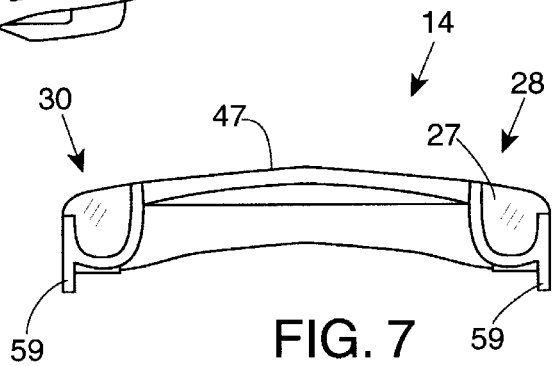
FIG. 7 is an elevation view looking back at the tail piece, as seen from the line 7—7 in FIG. 5.

As shown in the drawings, the rails 16 and 18 may be secured to the rail receiving aft portions 20 and 22 of the nose piece by rivets 26. A similar connection is made at the rear ends of the rails 16, 18, where they are nested into rail-receiving forward portions 28 and 30, in contoured openings 27 as shown in the transverse elevation view of FIG. 7. FIGS. 6 and 7 show that, in the case of the nose piece 12, the rail receiving channels 24 may be open at their bottom sides, while the rail receiving channels 27 of the tail piece 14 may be open at their top sides.

Figure 2:
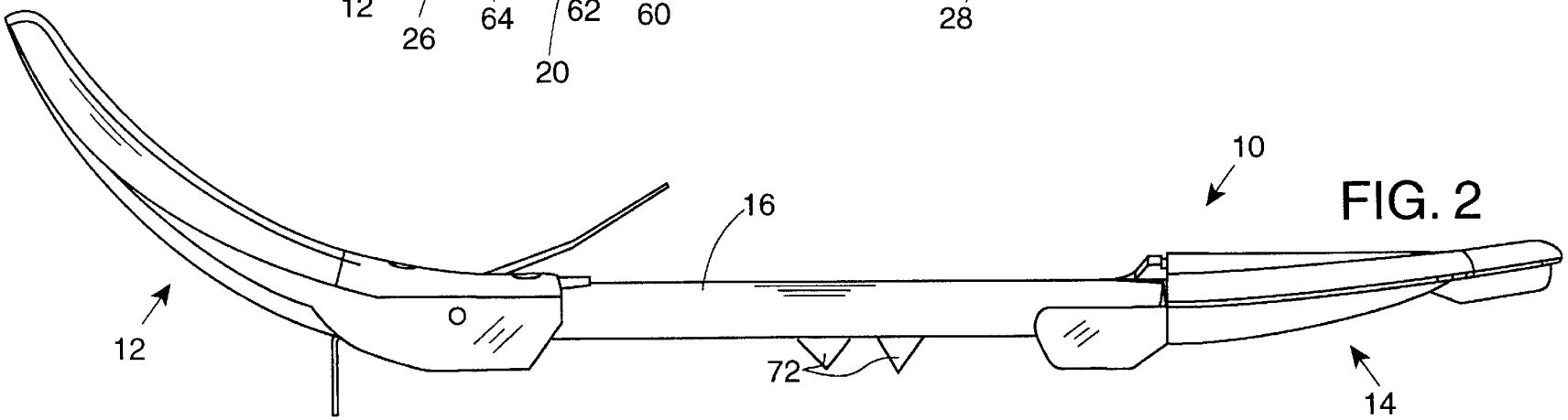
FIG. 2 is a side elevation view showing the snowshoe of FIG. 1.

FIGS. 1 and 2 also show a front claw 32 which forms part of a front claw/shoe harness assembly, although the harness assembly is removed from these drawings for clarity (the harness preferably is similar to that shown in U.S. Pat. No. 5,440,827). The front claw 32 has a downwardly extending serrated terrain engaging edge 34. The front claw 32, of sufficiently heavy gauge metal, is pivoted via pins 38 to frame structure of the snowshoe, and the pins 38 preferably pass through the rails 16 and 18 for a sturdy and rugged pivot support. FIG. 1 shows the pivot pin ends 38 in dashed lines, since these are located below the surface of the front claw 32, secured through downwardly extending tabs (not shown) of the claw.

Figure 3:
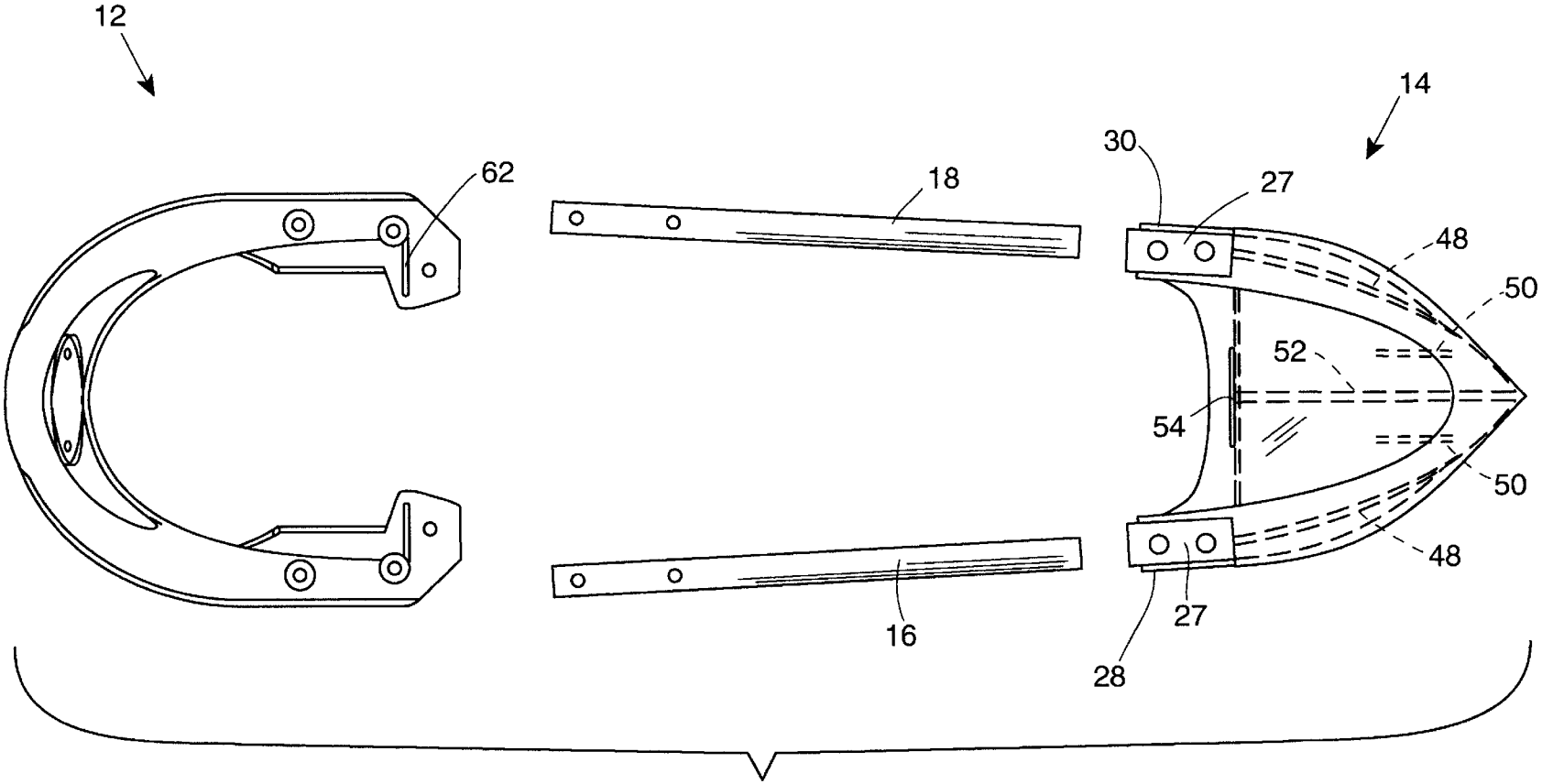
FIG. 3 is an exploded plan view of the snowshoe, showing front, central and rear sections as a nose, rails and tail, respectively.
Figure 4:
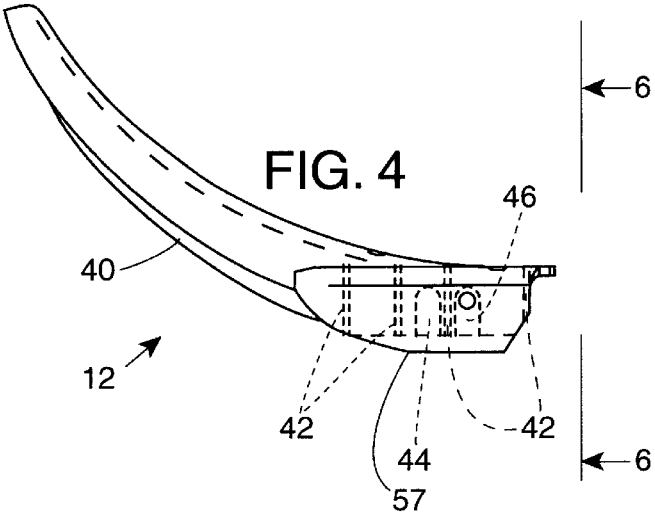
FIG. 4 is a side elevation view showing the nose portion of the snowshoe (before assembly).
Figure 6:
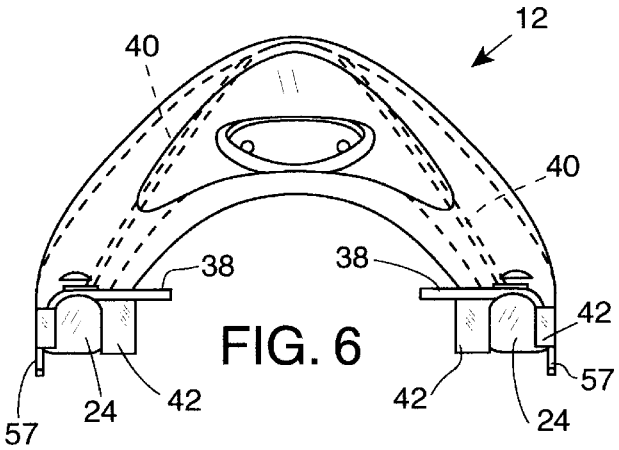
FIG. 6 is an elevation view looking forward at the nose piece, as seen from the line 6—6 in FIG. 4.

The nose piece 12 is shown separate from the remainder of the snowshoe in FIGS. 4, 6 and the exploded view of FIG. 3. This component, which may be injection or compression molded, preferably is formed of polypropylene, polyethylene or nylon. The nose piece is molded with ribs 40 at its bottom side, positioned so as to provide adequate strength for the nose. The rail-receiving channels 24 preferably are reinforced with a series of transverse ribs 42 as seen in FIGS. 4 and 6. FIG. 4 shows in dashed lines a slot-like opening 44 at the inboard side of the rail-receiving channel 24, through which the pin 28 extends in the assembled snowshoe; an alternate aft location 46 may be provided for a more aft position of the front claw/harness assembly for a snowshoe assembled with longer rails, in which the user's weight needs to be more aft.

Figure 5:
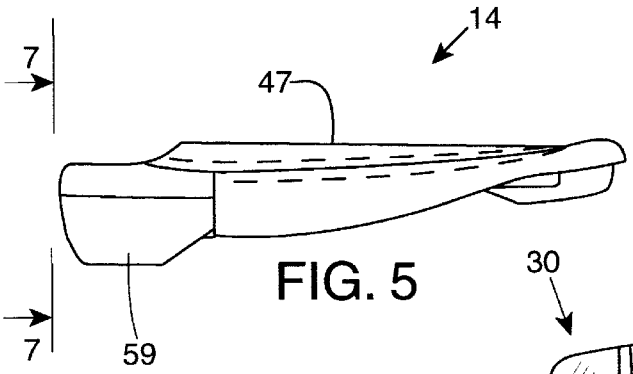
FIG. 5 is a side elevation view showing the tail piece of the snowshoe.

FIGS. 5 and 7 show the molded plastic tail piece 14, in side elevation and in elevation view looking rearwardly, respectively. The tail has a domed deck 47 as can be seen in these figures, to better shed snow. FIG. 3 also shows this component in the exploded view of the main components of the snowshoe assembly. This component, preferably molded of material similar to that of the nose piece 12, is reinforced by integrally molded ribs 48, 50 and 52 as indicated in dotted lines in FIG. 3, at the bottom side of this component. An elongated slot 54 is formed toward the forward end of the tail piece. This slot enables efficient assembly of a flexible deck membrane 56 onto the snowshoe, the deck membrane being shown in FIGS. 1, 1A and 8 and discussed further below.

As outlined above, the snowshoe preferably includes skegs at its bottom side for traction against lateral slippage. Skegs 57 and 59 are shown on the nose 12 and tail 14, respectively, as integrally molded downward protrusions. These preferably are at outboard locations but can be farther inboard if desired.

FIG. 3 shows the basic components, front, center and rear sections of the snowshoe as the nose 12, the rails 16 and 18 and the tail 14. From this exploded view it can be seen that the rails 16 and 18 can be made in different lengths, to result in various different lengths of snowshoes. The illustrated construction lends itself well to a modular system of different-length snowshoes, and also to adjustable-length snowshoes. As seen in the figure, the rails 16 and 18 are not parallel, and thus the range of different lengths useable is somewhat restricted by the fixed angularity of the rail-receiving channels 24 and 27 (FIGS. 6 and 7) of the nose and tail pieces. However, the plastic components 12 and 14 are somewhat flexible, and an adequate range of different-length snowshoes can be produced, varying by 4, 6 or even 8 inches. One limitation on length of the snowshoe is the position of the user's foot, which should be more aft for a longer snowshoe. As explained above, two alternate positions are provided for the pivot connection of the front claw/harness assembly, and additional, more-aft positions could be provided if desired.

Figure 1A:
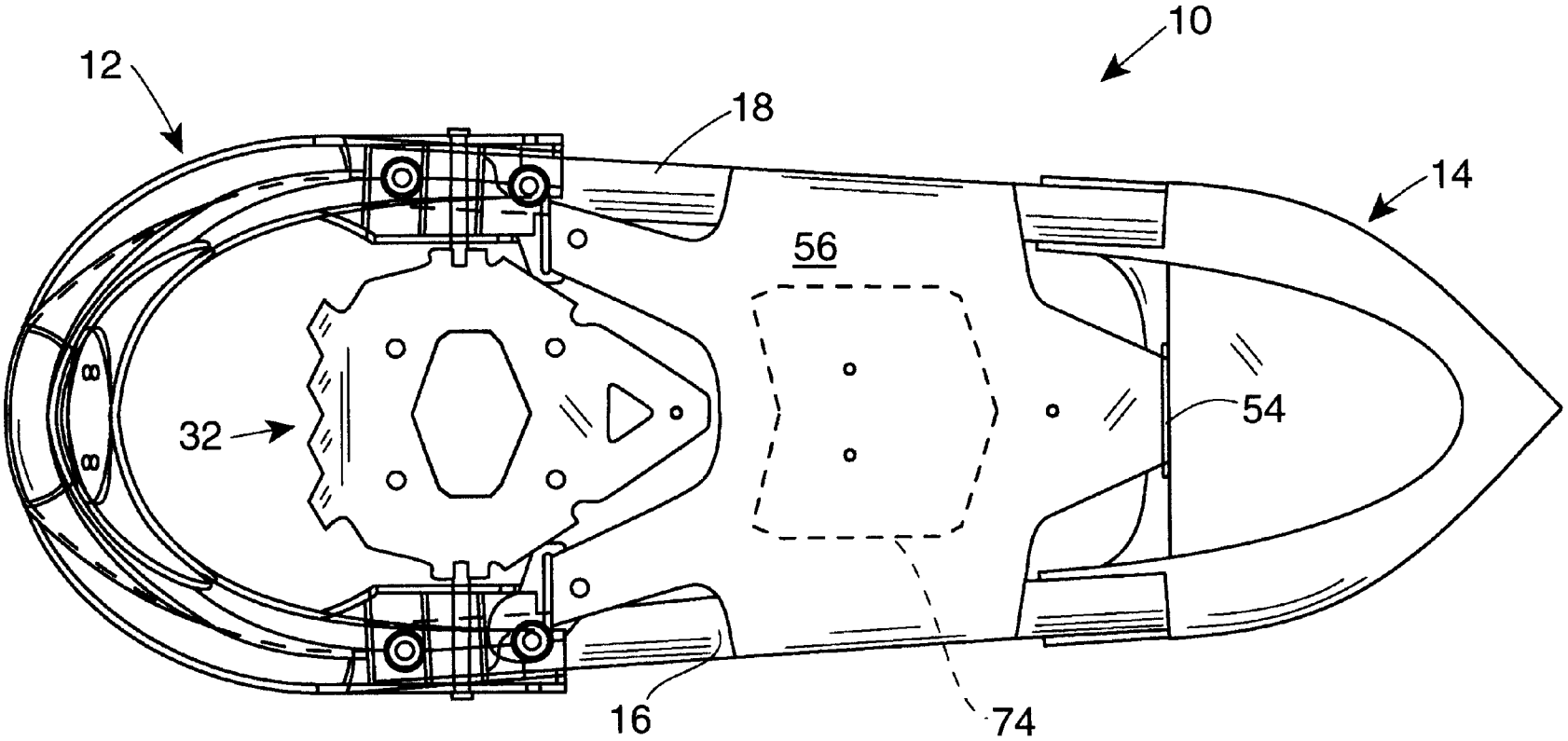
FIG. 1A is a view similar to FIG. 1 but indicating seaming under the snowshoe deck.
Figure 8:
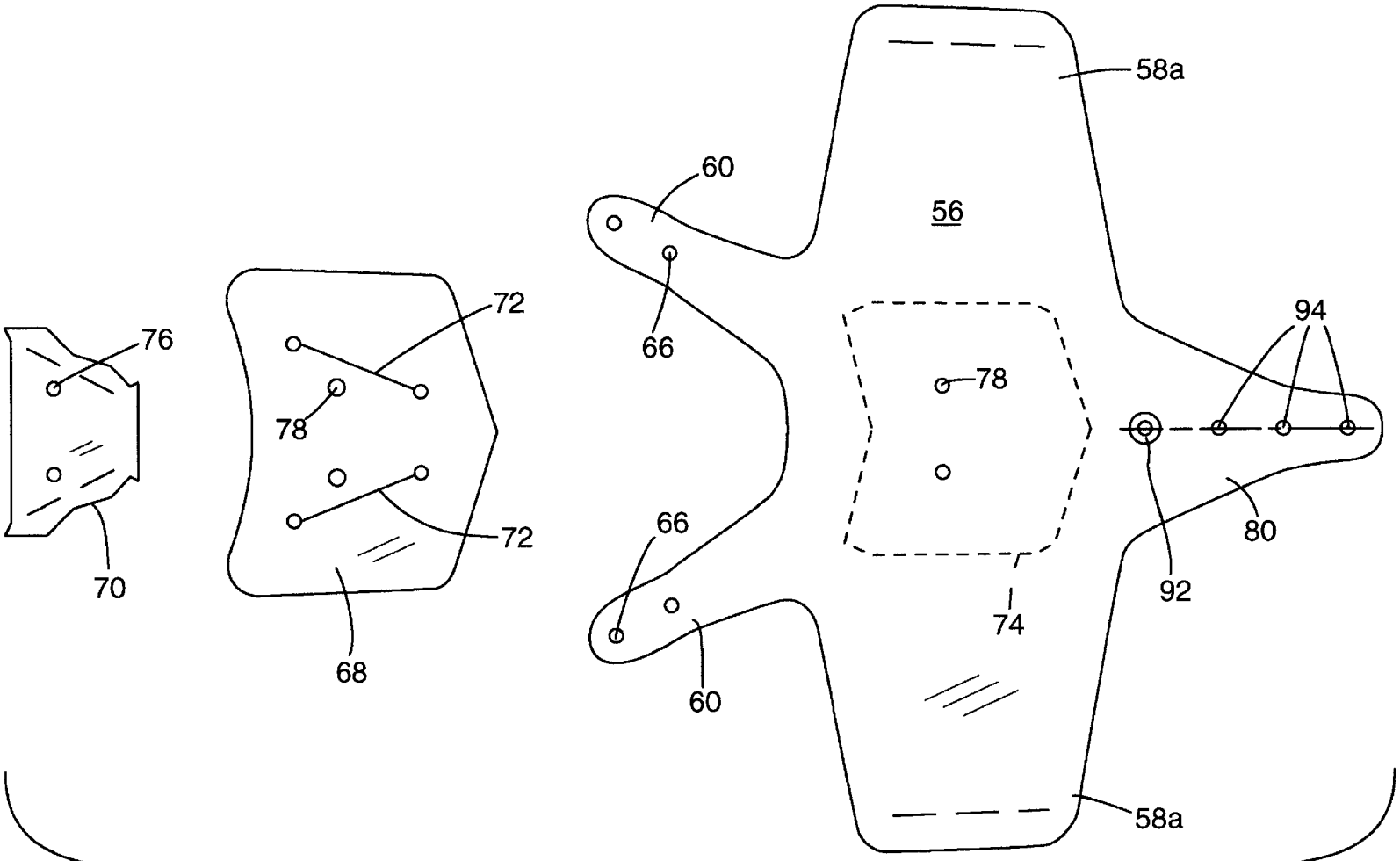
FIG. 8 is an exploded view to demonstrate assembly of a flexible membrane decking, including a heel cleat.

FIGS. 1, 1A and 8 show the manner in which the flexible deck membrane 56 is secured on the snowshoe, in preferred embodiments. In the embodiment illustrated, this stretched flexible decking material 56 is preferably a nylon scrim coated with PVC or urethane, a material which is heat-weldable. Thus, in FIG. 1, the decking material 56 is shown wrapped around the rails 16 and 18 and secured back to itself at the underside (under flaps shown in dashed lines). The dashed lines 58 indicate a bond line where the material may be secured together by RF welding or ultrasonic bonding. These flaps themselves are shown at 58*a* in FIG. 8.

As FIG. 1 also shows, forward legs 60 of the flexible membrane preferably are secured to forward structure of the snowshoe, which may be slots 62 through a horizontal plastic area 64 of the aft portions of the nose piece 12. These forward legs 60 are also shown in the exploded view of FIG. 8. The legs 60 may be bonded back to themselves at the underside by rivets passing through holes 66, or they may be heat bonded. The use of heat bonding, whenever possible, saves assembly cost over riveting.

FIG. 8, as well as FIG. 1A, also shows a cleat patch or lower reinforcing layer 68 of the deck membrane. A rear cleat 70, with downwardly extending serrated legs 72 as seen in the elevation view of FIG. 2, is assembled by passing the serrated edges through slits 72 in the cleat patch 68, and the cleat patch is then secured to the underside of the main deck membrane 56 by heat bonding, such as shown in outline by a dashed line 74 in FIG. 8. Rivets preferably are used, at holes 76 on the cleat and 78 on the patch and the membrane, to retain the rear cleat firmly in place. FIG. 1A shows the assembled snowshoe with the deck membrane 56, also indicating the heat bonding of the cleat patch, at 74.

A tail end strap 80 of the deck membrane is shown in FIG. 8. This may be wrapped through the tail slot 54 as noted above, and simply riveted to itself or heat bonded to itself. However, FIG. 8 shows an arrangement whereby the deck membrane 56 can accommodate different lengths of a snowshoe, in the event the snowshoe is made adjustable.

Figure 9:
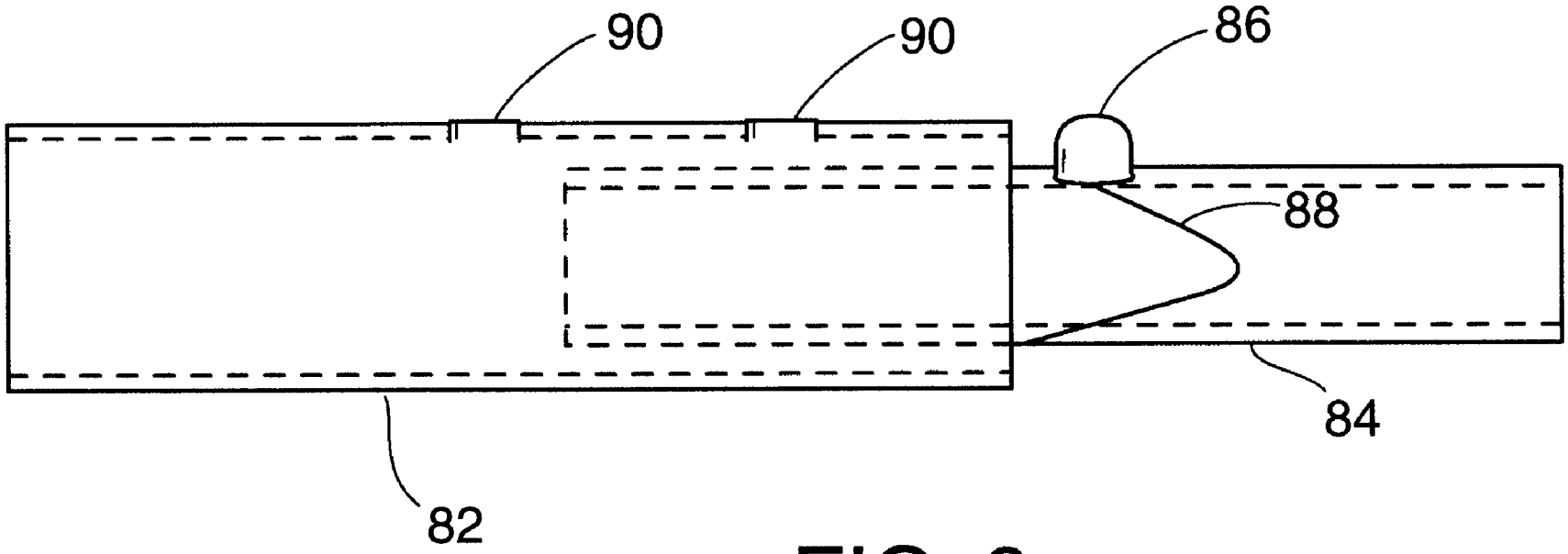
FIG. 9 is a detail view in elevation, showing an adjustable-length rail which allows the snowshoe adjustment to different lengths.

FIG. 9 shows structure which may be included in the rails to enable adjustment of the snowshoe length. In this embodiment, tubular rails are employed, and each tubular rail comprises a pair of telescoping tubes 82 and 84. A snap lock button 86, of the known type biased outwardly by a spring 88 in the tube 84, provides a locking feature by engaging with one or more holes 90 in the upper surface of the larger tube 82. When the relative positions of the telescoping tubes 82 and 84 are to be shifted, the user presses down the spring biased lock button 86 in the typical manner, releasing the tubes for movement. As noted above, several length positions can be defined, by providing two or more position holes 90. Also, the snowshoe can be collapsed to a shorter length for storage, by depressing the lock button 86 and pushing the rail tubes together as far as possible.

When the snowshoe length is changed via the adjustment structure shown in FIG. 9, the membrane tail strap 80 in FIG. 8 is released by releasing a snap 92, then reattaching the tail at a different degree of overlap, using a different one of several holes 94 provided for engagement with the snap. To maximize snow-contacting area of the snowshoe, the tail strap 80 can be made considerably wider, with the slot 54 also wider.

As one example, a fixed-rail snowshoe of the invention which is 24 inches in length may have rails about 12½ inches long, a nose about 9 inches long and a tail about 8 inches long (with rail-connection overlaps about 3 inches at the nose and about 2 to 2½ inches at the tail). With the same components, except 3-inch longer rails, for example, a 27 inch snowshoe could be produced.

As outlined above, some of the advantages of the invention can be obtained by providing a molded plastic nose piece 12, but otherwise forming a snowshoe frame generally in the manner shown in the referenced U.S. Pat. No. 5,440,827, the disclosure of which is incorporated herein by reference. Thus, a frame equivalent to that portion of the frame behind the harness assembly of U.S. Pat. No. 5,440,827 may be assembled into a nose piece 12, such as in the manner described above, with a stretched membrane deck then secured to the assembly generally in the manner shown and described in that patent.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

We claim:

1. A set of modular components for producing a plurality of different lengths of snowshoes using the modular components, comprising:

a plurality of similar snowshoe nose pieces, each having a pair of rail-receiving aft portions, a plurality of similar snowshoe tail pieces, each having a pair of rail-receiving forward portions, a series of pairs of rails including pairs of different lengths, the rails having ends capable of assembly to said rail-receiving aft portions and to said rail-receiving forward portions of the nose pieces and the tail pieces, respectively, to form a rigid snowshoe frame, means for permanent attachment of the ends of the rails to said rail-receiving aft portions and to said rail-receiving forward portions, a plurality of flexible deck membranes, each with means for securing the deck membrane to a said pair of rails after the rails have been secured to one of said nose pieces and to one of said tail pieces, such that the deck membrane is in a position to be beneath a user's heel to provide a non-rigid surface for contact by the user's heel, a plurality of similar front snowshoe claws, each claw having secured to it a boot attachment means for receiving a shoe or boot of a user, and means for securing each front snowshoe claw to a snowshoe frame formed from one of said pairs of rails of selected length, one of said nose pieces and one of said tail pieces, whereby, using the set of modular components, snowshoes of different lengths can efficiently be produced, the different lengths of snowshoes all having similar snowshoe nose pieces and similar snowshoe tail pieces as well as similar front snowshoe claws.

2. A set of modular components as in claim 1, wherein the means for securing each front snowshoe claw includes pivot means providing for pivoting of the claw about a transverse horizontal axis.

3. A plurality of snowshoes of different lengths and having similar nose pieces, tail pieces and front snowshoe claws, formed with the components of claim 1.

4. A method for producing a plurality of different lengths of snowshoes using modular components, comprising:

providing a plurality of similar snowshoe nose pieces, each having a pair of rail-receiving aft portions, providing a plurality of similar snowshoe tail pieces, each having a pair of rail-receiving forward portions, providing pairs of rails, including pairs of different lengths, and selecting a pair of rails of appropriate lengths to produce a snowshoe of desired length, securing with permanent attachments the selected pair of rails in spaced apart relationship to the rail-receiving aft portions of one of said plurality of similar nose pieces and to the rail-receiving forward portions of one of said plurality of similar tail pieces, so as to form a rigid snowshoe frame, securing to the two spaced apart rails a flexible deck membrane, in a position to be beneath a user's heel so as to provide a non-rigid surface for contact by the user's heel, securing, by a connection providing for pivoting about a transverse horizontal axis, a front claw to the snowshoe frame, the front claw having secured to it a boot attachment means for receiving a shoe or boot of a user, and repeating the above procedure to produce additional snowshoes, at least some of which are formed with rails of a different length but all of which are formed with said similar snowshoe nose pieces and said similar snowshoe tail pieces, to efficiently produce snowshoes of different lengths.

* * * * *